US007082801B2

(12) United States Patent
Di Giacomo

(10) Patent No.: US 7,082,801 B2
(45) Date of Patent: Aug. 1, 2006

(54) TIGHTENING AND UNTIGHTENING DEVICE FOR BEARINGS OF ROLLING MILLS

(75) Inventor: Marco Di Giacomo, Cormons (IT)

(73) Assignee: Danieli & C.Officine Meccaniche S.p.A., Buttrio (IT)

( * ) Notice: Subject to any disclaimer, the term of this patent is extended or adjusted under 35 U.S.C. 154(b) by 183 days.

(21) Appl. No.: 10/491,862

(22) PCT Filed: Oct. 4, 2002

(86) PCT No.: PCT/EP02/11180

§ 371 (c)(1),
(2), (4) Date: Apr. 7, 2004

(87) PCT Pub. No.: WO03/031088

PCT Pub. Date: Apr. 17, 2003

(65) Prior Publication Data

US 2004/0231388 A1 Nov. 25, 2004

(30) Foreign Application Priority Data

Oct. 9, 2001 (IT) ..... MI2001A2082

(51) Int. Cl.
*B21B 31/00* (2006.01)

(52) U.S. Cl. ..... 72/237; 72/238

(58) Field of Classification Search ..... 72/237, 72/252.5, 238, 239

See application file for complete search history.

(56) References Cited

U.S. PATENT DOCUMENTS

| | | | | |
|---|---|---|---|---|
| 3,003,836 | A * | 10/1961 | Hill | 72/237 |
| 3,289,282 | A | 12/1966 | Shaffer | |
| 3,531,969 | A | 10/1970 | Amino et al. | |
| 4,186,629 | A | 2/1980 | Costes | |
| 4,341,426 | A * | 7/1982 | Clapp | 384/487 |
| 4,589,269 | A * | 5/1986 | Michaux | 72/247 |
| 5,029,461 | A * | 7/1991 | Lawrence et al. | 72/238 |
| 5,046,870 | A * | 9/1991 | Ordo | 384/563 |
| 6,286,394 | B1 | 9/2001 | Kark | |

FOREIGN PATENT DOCUMENTS

| | | |
|---|---|---|
| JP | 49-51152 | 5/1974 |
| JP | 56-91914 | 7/1981 |

OTHER PUBLICATIONS

Patent Abstracts of Japan vol. 005, No. 166 (M-093), Oct. 23, 1981—& JP 56 091914 A (Kobe Steel Ltd), Jul. 25, 1981 abstract (of JP56-91914).

* cited by examiner

*Primary Examiner*—Derris H. Banks
*Assistant Examiner*—Teresa M. Bonk
(74) *Attorney, Agent, or Firm*—Sampson & Associates, P.C.

(57) ABSTRACT

A tightening and untightening tool for a roll bearing assembly of a rolling mill has a box-shaped body of toroidal shape with a central hole fitting around the cylindrical end part of a back-up roll. It has drive keys that slide into corresponding drive splines on the outside of the locknut and a torque reaction slot that fits over a reaction plate. The tool is provided with a hydraulic drive motor for tightening with bearing locknut against a thrust bearing.

6 Claims, 2 Drawing Sheets

TIGHTENING AND UNTIGHTENING DEVICE FOR BEARINGS OF ROLLING MILLS

This application claims priority to International Patent Application Ser. No. PCT/EP02/11180 filed on 4 Oct. 2002, claiming priority to Italian Patent Application Ser. No. MI12001A002082 filed on 9 Oct. 2001.

FIELD OF THE INVENTION

The present invention relates to a tightening and untightening device which may be temporarily mounted on bearing assemblies of rolls in rolling mills, in particular for tightening and untightening the bearing locknut placed on the roll necks end portion.

STATE OF THE ART

In rolling mills, especially in back-up rolls, it is usual practice to employ screw or hydraulically actuated devices for locking or tightening rolling mill bearing assemblies onto their positions on the roll necks. In a similar manner some of these devices are also employed for unlocking or untightening the bearings whenever the latter have to be removed from the roll neck, e.g. for normal or extraordinary maintenance operations.

In the state of the art rolling plants, locking devices of that kind are often designed as integral components of the bearing assemblies, thereby adding considerably to the cost of the bearing assemblies.

Additional drawbacks of known screw actuated locking devices consist in the fact that they are rather difficult to tighten or to loosen, often requiring the use of cables tensioned by overhead cranes. This procedure, not only is cumbersome, but it increases the risk of injury to maintenance personnel and of damage to equipment in the vicinity of the rolling mill.

For these reasons users prefer nowadays to employ portable hydraulically actuated tools which may be temporarily connected to the bearing assemblies of the rolling mills, because of their simplicity and labour-saving benefits in comparison to the former types of devices. However, many such tools are still laborious to operate for untightening the bearing assemblies. Thus, the dismounting operation must in some cases be effected by other means, for example still by use of overhead cranes and/or other hydraulically or mechanically actuated devices. Thus there exist a need to convert existing tightening and untightening devices of the non portable type with lighter portable devices

SUMMARY OF THE INVENTION

It is a primary object of the present invention to overcome the above mentioned drawbacks of known tightening and untightening devices by providing an easily operable, time and labour saving tightening and untightening device of simple construction and compact in size, adapted for tightening and untightening bearing assemblies on the roll neck of rolls in rolling mills.

It is another object of the present invention to provide a tightening and untightening device which ensures cost savings during operation, reduces maintenance and allows low-cost conversion of earlier, more laborious tightening systems.

A further object of the present invention is to provide a tightening and untightening device adapted for operation in combination with structurally simple roll end sections.

A not less important object of the present invention is to provide a tightening and untightening device with increased safety of operation.

These objects are achieved by means of a tightening and untightening device for use on a rolling mill bearing assembly, with a box-like substantially toroidal shape and defining an axis, comprising first and second annulus-shaped plate elements placed face to face at a predefined reciprocal distance along said axis, said first plate element being solidarily fixed to an internal ring element and provided with first coupling means adapted to couple said tightening and untightening device to a portion of said rolling mill bearing assembly during operation, said second plate element being solidarily fixed to a ring shaped gear wheel and provided with second coupling means adapted to couple said tightening and untightening device to a lock element of said rolling mill bearing, said first and second plate elements being joined by means of a roll bearing for reciprocal relative rotation around said axis generated by means of a drive motor solidarily fixed on said first plate element.

The inventive arrangement of the tightening and untightening device has a reduced number of component parts and can be associated with a particularly simple roll bearing assembly. The cost reduction for the roll plants resulting from this is thus substantial. Its structural simplicity and compactness makes it easy to use and to repair whenever needed. As it is extractable from its seat on the mill bearing assembly and rather handy, one hydraulic locking and untightening tool can be employed for a number of roll stands and even for the whole mill line if necessary. Two or more different variants can be produced in the framework of the invention in order to adapt the device to the different types of bearings used on rolling mills, e.g. one for the bearings on the thrust side and another for the bearings on the non-thrust side of the mill.

BRIEF DESCRIPTION OF THE FIGURES

Further advantages and aspects of the invention will become apparent from the detailed description of preferred, non limitative, embodiments of a tightening and untightening device, hereafter shown by way of non-limitative examples by means of the accompanying drawings, in which.

DETAILED DESCRIPTION OF PREFERRED EMBODIMENTS OF THE INVENTION

Figure 2:
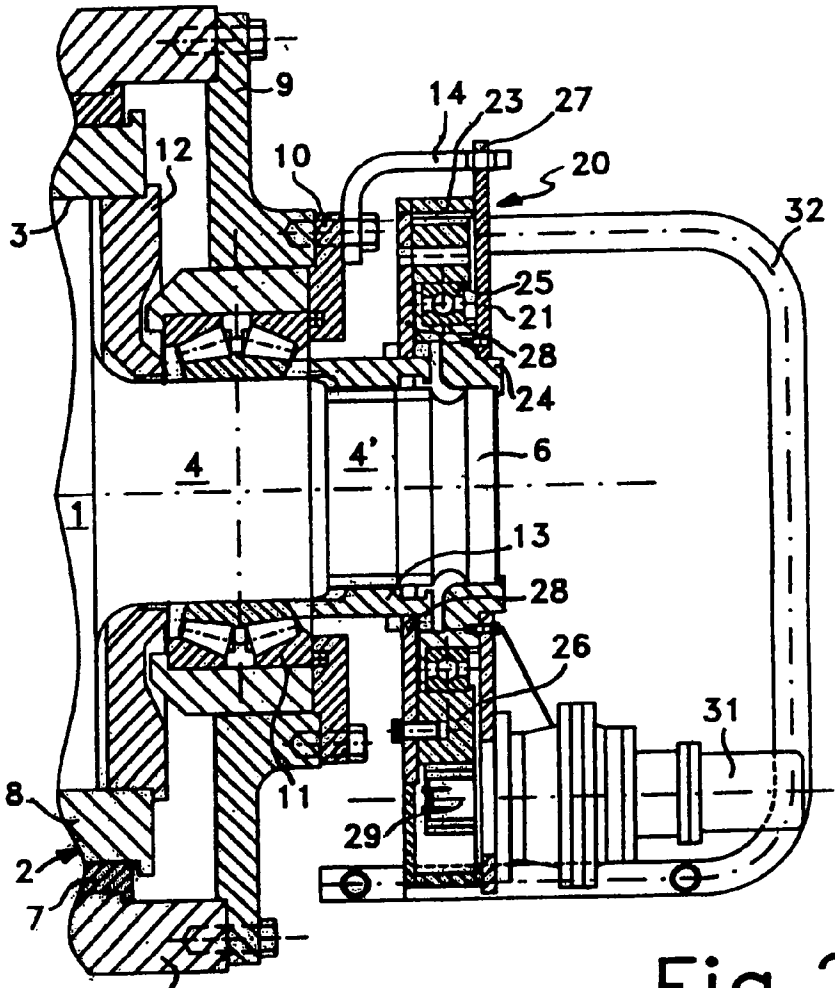
FIG. 2 shows a longitudinal sectional view of the device of FIG. 1 along line A—A.
Figure 1:
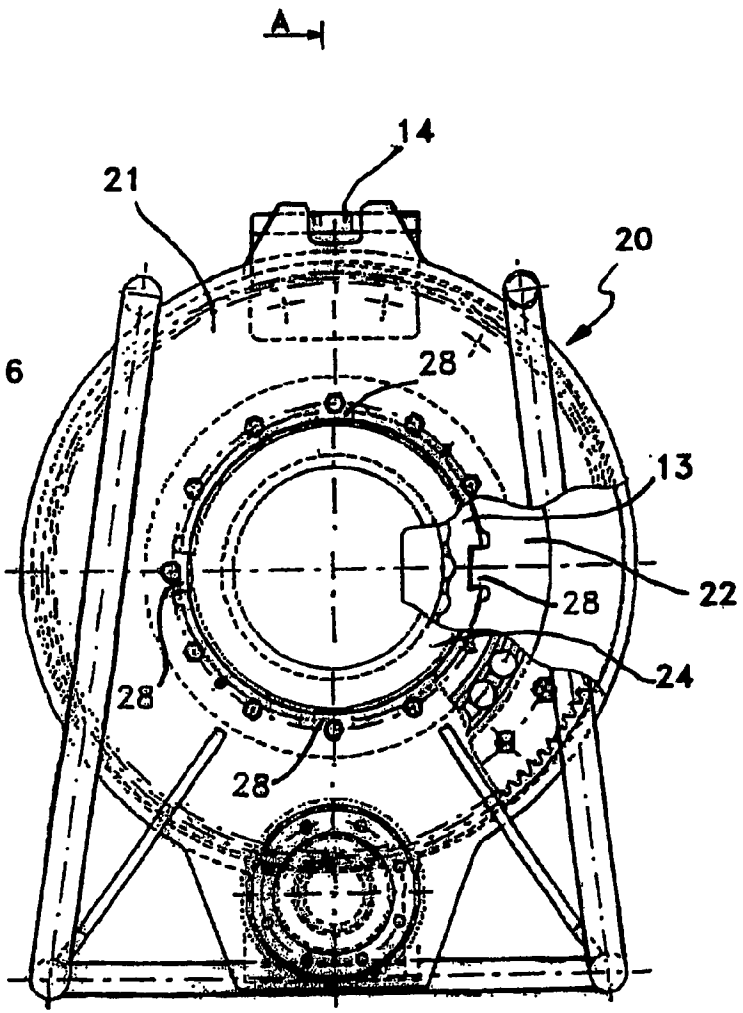
FIG. 1 shows a front view of a first embodiment of the device according to the invention coupled on a corresponding bearing assembly of a rolling mill for operation.

With reference to the mentioned FIGS. 1 and 2, there is shown an end portion of a roll 1, e.g. a back-up roll, supported by a bearing assembly, e.g. of the oil film type, which is globally indicated by reference numeral 2. The end portion of the back-up roll 1 has a tapered first portion 3 and a cylindrical second part 4 which are both rotatably supported inside a housing of the frame 5 of the rolling mill. The oil film bearing 2 comprises a bush 7, made generally of white metal, and a sleeve 8 with tapered internal surface fitting on the tapered part 3 of the roll 1. The bush 7 surrounds the sleeve 8 and is provided with oil supply ports, not shown in detail in the figures, and is fixed against rotation to the frame 5 whereas the sleeve is in turn solidarity fixed against rotation on the roll neck.

In correspondence of the end portion of the bearing assembly there is provided a chock end plate 9 fixed on the frame 5 by means of screws and closed on the external side with a flange 10. Around the cylindrical extremity 4 of the roll neck there is inserted a thrust bearing 11, held inside a corresponding hole of the chock end plate 9. The inner race of the thrust bearing 11 is held in abutment between a ring 12, placed on the inner side of the roll neck and a threaded ring or locknut 13 screwed on the threaded end portion 4' of the roll neck on the outer side. The locknut 13 ensures the necessary locking force against untightening of the roll bearing 2 during operation of the rolling mill.

An angular element 14, e.g. consisting of a bent plate, is fixed to the flange 10 of the chock, or to any other appropriate place on the rolling mill structure, for creating a reaction point to the tightening and untightening torque generated by operation of the device.

The tightening and untightening device, globally indicated with reference numeral 20, in the FIGS. 1 and 2 is shown mounted on the extremity 6 of the roll neck for operation. It has a box-like toroidal shape and comprises two annuli 21 and 22 placed at a distance in front of each other. An external ring 23 is solidarity fixed to the annulus 22 and to a ring shaped gear 26. An internal ring element 24 is solidarity fixed to the annulus 21, and can rotate with respect to the annulus 22, by means of a roll bearing 25. The hole of the ring 24 is such that it is adapted to fit the device 20 on the roll neck end part 6 during operation. The annulus 21 is provided with a slot 27 on the external rim for coupling to the reaction plate 14. One or, preferably, a plurality of keys 28 made on the internal rim of the annulus 22 are adapted to couple with corresponding drive splines made on the outside surface of the locknut 13.

A hydraulic drive motor 31 is solidarily fixed to the annulus 21 and drives a pinion gear 29 which engages the ring shaped gear 26. Depending on the torque to be generated by the drive motor 31, the latter could be also an electric motor or any suitable motor.

The tightening and untightening device can be also advantageously fitted with a truss frame 32 suitable for making easier gripping with hands, resting on the ground or handling by any appropriate mechanical means.

This embodiment is advantageously, though not exclusively, used for roll necks on the thrust side of the rolling mill.

Figure 4:
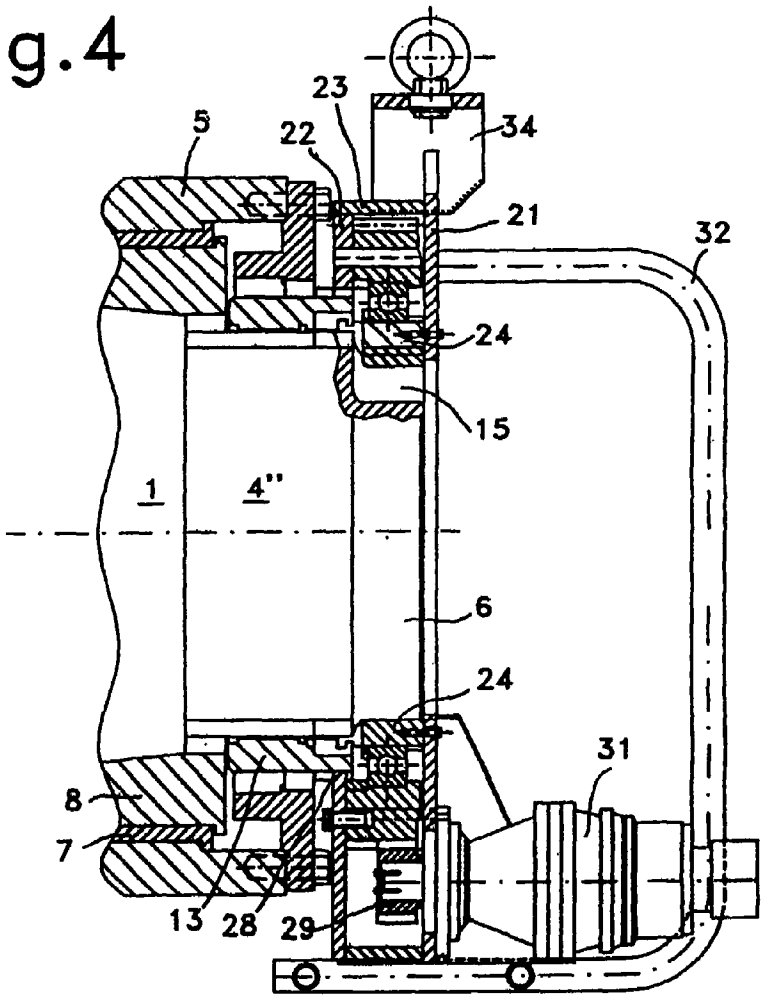
FIG. 4 shows a longitudinal sectional view of the hydraulic device of FIG. 3 along line A—A.
Figure 3:
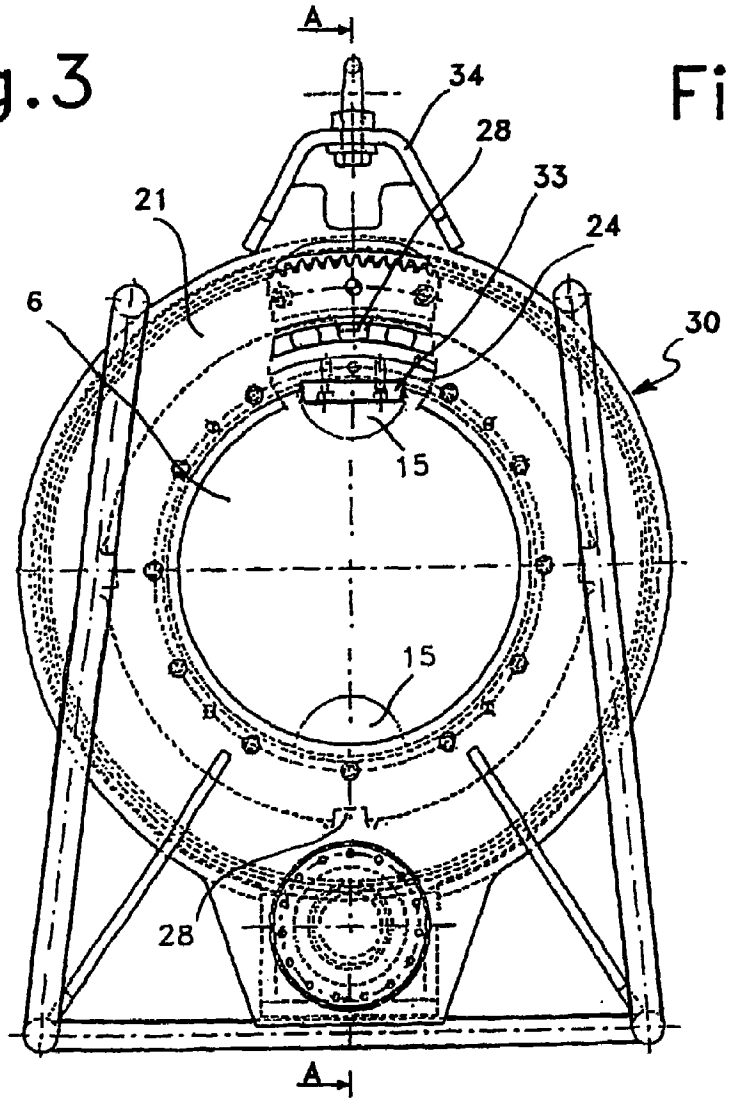
FIG. 3 shows a front view of another embodiment of the device according to the invention coupled on a corresponding bearing assembly of a rolling mill for operation.

With particular reference to a second embodiment of the invention, shown in FIGS. 3 and 4, the tightening and untightening device, globally indicated with reference numeral 30, is illustrated in the position mounted on the roll neck 4 for operation. The elements corresponding to those of the embodiment above described with reference to FIGS. 1 and 2 are indicated with the same reference numerals.

This embodiment of the device 30 differs from the preceding one in that it comprises a torque reaction element 33 placed on the internal rim of the annulus 21 and able to engage a spline 15 available on the extremity of the roll neck 4. More than one torque reaction elements can be envisaged if this is considered appropriate, e.g. for structural reasons.

Advantageously a support element 34, like a ring, can also be provided for better hooking by means of an overhead crane or any appropriate lifting means. This second embodiment is advantageously, though not exclusively, used for roll necks of the non-thrust side of a rolling mill and in this case the bearing assembly does not generally have a thrust bearing.

Tightening operation of the device 20, 30, or tool, according to the invention occurs in the following manner. The chock and bearing assembly is fitted onto the back-up roll neck 4 in the known manner using an overhead crane. With the chock held in position using the overhead crane or blocks and wedges the bearing locknut 13 is fitted onto the roll neck threaded portion 4', 4" and turned until it comes into contact with the inner race of the thrust bearing 11 or of the sleeve 8, depending on the variants of the bearing assembly the device is used upon. Using the overhead crane or any suitable mobile lifting frame the tightening tool 20, 30 is fitted onto the back-up roll end and over the bearing locknut, thus ensuring that the tool drive keys 28 slide into the corresponding drive splines on the outside diameter of the locknut 13 and the torque reaction slot 27 in the tool body fits over the torque reaction plate 14 mounted on the bearing chock end plate or, alternatively, that the element 33 fits over the torque reaction spline 15 on the roll end 6. With the tool 20, 30 correctly installed on the roll end 6 the hydraulic power pack, not illustrated in the figures, is connected to the tightening tool drive motor 31.

The tightening tool is now driven in the clockwise, or tightening, direction by the drive motor 31, thus tightening the bearing locknut 13 against the thrust bearing 11, or alternatively against the conical sleeve 8, and locking the complete chock and bearing assembly onto the back-up roll. When the correct tightening torque for the locknut 13 is achieved a pressure limiter on the hydraulic power pack, or an equivalent device, is activated and the drive motor 31, is automatically stopped. The hydraulic power pack is subsequently disconnected from the tool 20, 30 and the tool itself removed from the locknut 13 and back-up roll end 4 with the 30 overhead crane or dedicated mobile lifting frame.

The procedure for untightening and dismounting of the chock and bearing assembly using the same device is the reverse of the above described, with the device 20, 30 according to the invention being used as untightening device in the following manner. With the back-up roll 1 and chock assembly correctly supported the tightening tool 20, 30 is fitted onto the back-up roll end 4 and over the bearing locknut 13 using an overhead crane or any suitable device, like a dedicated mobile lifting frame, ensuring that the tool drive keys 28 slide into the drive splines on the outside diameter of the locknut 13 and the torque reaction slot 27 in the tool body fits over the torque reaction plate 14, mounted on the bearing chock end plate or, alternatively, that the element 33 fits over the torque reaction spline 15 present on the roll end 6.

The hydraulic power pack is now connected to the tightening tool drive motor 31 and the tool driven in the anticlockwise direction to untighten the bearing locknut by one turn of the thread and therefore unlock the chock and bearing from the roll 1.

The hydraulic power pack is now disconnected from the tool 20, 30 and the tool itself removed from the locknut 13 and back-up roll end 6 with the overhead crane or dedicated mobile lifting frame. The bearing locknut 13 is now manually unthreaded off the roll neck threaded portion 4' or 4" to enable the chock and bearing assembly to be removed from the back-up roll 1.

From what has been said above it is apparent that the locking and untightening device according to the invention reaches all the objects set before. Its design provides for time and labour savings in comparison to state of the art tightening devices and for cost savings as the device according to the invention is not permanently connected to one roll only and the structure of the back-up roll end section, of the chock end plate and of the cover is simplified. Thanks to its simple design, maintenance is rendered easier and its use straightforward.

The invention claimed is:

1. Tightening and untightening device (20, 30) for use on a rolling mill bearing assembly, with a box-like substantially toroidal shape and defining an axis, comprising first and second annulus-shaped plate elements (21, 22) placed face to face at a predefined reciprocal distance along said axis, said first plate element (21) being solidarily fixed to an internal ring element (24) and provided with first coupling means (15, 27) adapted to couple said tightening and untightening device (20, 30) to a portion of said rolling mill bearing assembly during operation, said second plate element (22) being solidarity fixed to a ring shaped gear wheel (26) and provided with second coupling means (28) adapted to couple said tightening and untightening device (20, 30) to a lock element (13) of said rolling mill bearing, said first and second plate elements (21, 22) being joined by means of a roll bearing (25) for reciprocal relative rotation around said axis generated by means of a drive motor (31) solidarity fixed on said first plate element (21).

2. Tightening and untightening device according to claim 1, wherein the internal ring element (24) is adapted for coupling on the axial extremity (6) of said roll during operation.

3. Tightening and untightening device according to claim 1, wherein said first coupling means comprise a slot (27) on the external rim of said first plate element (21) for coupling to a reaction plate (14) on the bearing assembly.

4. Tightening and untightening device according to claim 3, wherein said second coupling means comprise a plurality of keys (28) made on the internal rim of the second plate element (22) and adapted for coupling to corresponding drive splines provided on the lock element (13).

5. Tightening and untightening device according to claim 1, wherein said drive motor (31) is actuated by hydraulic power and drives a pinion gear (29) engaging said ring shaped gear (26).

6. Tightening and untightening device according to claim 1, wherein an external ring (23) is solidarity fixed to said first plate element (22).

* * * * *